US009797155B2

(12) United States Patent
McMahon

(10) Patent No.: US 9,797,155 B2
(45) Date of Patent: Oct. 24, 2017

(54) PHYSICAL EXERCISE TRAINING TECHNIQUES

(71) Applicant: Gregory Michael McMahon, Samford (AU)

(72) Inventor: Gregory Michael McMahon, Samford (AU)

( * ) Notice: Subject to any disclaimer, the term of this patent is extended or adjusted under 35 U.S.C. 154(b) by 0 days.

(21) Appl. No.: 14/845,669

(22) Filed: Sep. 4, 2015

(65) Prior Publication Data

US 2015/0376911 A1 Dec. 31, 2015

Related U.S. Application Data

(63) Continuation of application No. 14/006,958, filed as application No. PCT/AU2012/000523 on May 11, 2012, now abandoned.

(51) Int. Cl.

| | |
|---|---|
| ***E04H 15/20*** | (2006.01) |
| ***E04H 3/16*** | (2006.01) |
| ***E04H 4/10*** | (2006.01) |
| ***A63B 69/00*** | (2006.01) |
| ***E04B 1/343*** | (2006.01) |

(52) U.S. Cl.

CPC ..... *E04H 15/20* (2013.01); *A63B 69/00* (2013.01); *E04B 1/34326* (2013.01); *E04H 3/16* (2013.01); *E04H 4/103* (2013.01); *E04H 4/108* (2013.01); *A63B 69/0028* (2013.01); *A63B 2208/056* (2013.01); *A63B 2244/20* (2013.01); *E04H 2015/201* (2013.01); *E04H 2015/208* (2013.01)

(58) Field of Classification Search

CPC E04H 3/16; E04H 4/103; E04H 4/108; E04H 15/20; E04H 2015/201; E04H 2015/208; E04B 1/34326; A63B 69/00; A63B 69/0028; A63B 2208/056; A63B 2244/20

See application file for complete search history.

(56) References Cited

U.S. PATENT DOCUMENTS

| | | | | | |
|---|---|---|---|---|---|
| 1,964,818 | A | * | 7/1934 | Hood | E04H 15/20 135/156 |
| 2,895,490 | A | | 7/1959 | Dimond | |
| 3,006,339 | A | | 10/1961 | Smith | |
| 3,338,001 | A | * | 8/1967 | Fraser | E04H 15/20 52/2.21 |
| 3,779,847 | A | * | 12/1973 | Turner | E04H 15/20 156/156 |
| 4,000,749 | A | | 1/1977 | Busco | |
| 4,197,681 | A | * | 4/1980 | Holcombe | E04C 3/005 135/119 |
| 4,296,960 | A | * | 10/1981 | Winchester | B60P 3/32 135/88.13 |

(Continued)

*Primary Examiner* — Jeanette E Chapman

(74) *Attorney, Agent, or Firm* — Renner, Otto, Boisselle & Sklar, LLP; Grant Steyer

(57) ABSTRACT

A swimming pool cover assembly including a frame, at least one cover, and an adjustment means. The frame including at least one inflatable portion and an interconnected three-dimensional (3D) lattice of inflatable straight tubes. The at least one cover is supported by the frame to define an exercise chamber including at least part of a swimming pool. The adjustment means reduces an oxygen content of air in the exercise chamber compared with air external the exercise chamber. The exercise chamber has elongate sidewalls.

20 Claims, 9 Drawing Sheets

(56) References Cited

U.S. PATENT DOCUMENTS 4,309,851 A * 1/1982 Flagg ..... E04H 15/006 446/110
4,317,315 A * 3/1982 LeBlang ..... E04H 15/20 156/270
4,427,385 A 1/1984 Galerne
4,556,391 A 12/1985 Tardivel et al.
4,918,877 A 4/1990 Dutka
4,974,829 A 12/1990 Gamow et al.
5,109,837 A 5/1992 Gamow
5,247,768 A * 9/1993 Russo ..... E04H 15/20 52/2.13
5,293,652 A 3/1994 Furr
5,360,001 A 11/1994 Brill et al.
5,398,678 A * 3/1995 Gamow ..... A61G 10/026 128/202.12
5,570,544 A * 11/1996 Hale ..... E04H 15/20 52/2.11
5,692,795 A * 12/1997 Mininger ..... E04H 15/20 135/88.13
5,761,852 A * 6/1998 Liu ..... E04H 15/20 446/220
5,906,373 A * 5/1999 Sanders ..... A63B 67/00 273/349
5,987,822 A * 11/1999 McNiff ..... E04H 15/20 135/125
6,179,367 B1 * 1/2001 Bowen ..... E04H 15/06 135/124
6,192,633 B1 2/2001 Hilbert
6,347,628 B1 2/2002 Maison
6,679,811 B2 1/2004 Chen
6,799,338 B1 * 10/2004 Hsia ..... A47D 13/063 5/93.1
7,520,277 B1 4/2009 Grady
7,556,040 B2 7/2009 Meyer et al.
8,297,282 B2 10/2012 Holley et al.
2004/0050411 A1 * 3/2004 Lawrence ..... E04H 15/20 135/128
2004/0134133 A1 * 7/2004 Busby ..... A47C 27/087 52/2.11
2005/0049090 A1 3/2005 Chen
2005/0109381 A1 5/2005 Mosteller
2006/0169284 A1 8/2006 Meyer et al.
2007/0186466 A1 8/2007 Gardiner
2007/0221225 A1 9/2007 Kutt et al.
2009/0107020 A1 * 4/2009 Aires ..... G09F 7/00 40/610
2009/0217930 A1 9/2009 Holley et al.
2011/0023378 A1 * 2/2011 Hogue ..... E04H 1/1272 52/2.18
2011/0136597 A1 * 6/2011 Gordon ..... A63B 5/11 473/478

* cited by examiner

ILLUSTRATION CONTINUED FROM SHEET 2

PHYSICAL EXERCISE TRAINING TECHNIQUES

This application is a continuation of application Ser. No. 14/006,958 filed on Sep. 23, 2013, which is a national phase of PCT Application No. PCT/AU2012/000523 filed May 11, 2012, which claims priority to AU2011202180 filed on May 11, 2011, all of which are hereby incorporated herein by reference.

TECHNICAL FIELD

The present invention generally relates to physical exercise training. The present invention has particular, although not exclusive application to swimming.

BACKGROUND

The reference to any prior art in this specification is not, and should not be taken as an acknowledgement or any form of suggestion that the prior art forms part of the common general knowledge.

Elite sports is a serious business with athletes seeking every opportunity to gain a competitive edge over their rivals. Altitude training can be undertaken prior to major competitions whereby some endurance athletes train for several weeks in the mountains at high altitude. However, amateur athletes are often unable to afford the time and money involved with such altitude training.

It is an object of the present invention to provide a time and/or cost effective alternative for altitude conditioning.

SUMMARY OF THE INVENTION

According to one aspect of the present invention, there is provided a cover assembly including:

a frame including at least one inflatable portion;

at least one cover for being supported by the frame to define a chamber; and adjustment means for facilitating adjustment of the air conditions in the chamber compared with air conditions external the chamber.

The cover may cover an exercise training area.

The frame may be formed from an interconnected three-dimensional (3D) lattice of inflatable tubes. The frame may include wall frame portions. Each wall frame portion form a single-dimensional array. The frame may include roof portion. The roof portion form a rectangular multi-dimensional array.

The cover may include a single sheet or multiple sheets of material for affixing to the frame. The cover may include removable side panels of material for affixing within endless side portions of the frame. The cover may partition internal wall frame portions. The material may be air impervious and formed from transparent polymeric material. The cover may be affixed to the frame using a hook-and-loop (e.g. Velcro™) fastening arrangement.

The exercise training area may include one or more training lanes. The lanes may be swimming or running lanes. Each wall portion may be aligned along a side of a training lane.

The cover assembly may further include one or more end strip doors. Each strip door may include a number of hanging PVC strips.

The frame may include a plurality of handles to facilitate handling when deflated. The frame may include a plurality of fastening means to which backstroke flags can be transversely fastened across the assembly. Each fastening means may include a ring.

The assembly may further include one or more conduits for conveying pressurised air into or out of the cover assembly. The assembly may further include a pump for pumping air in or out of the conduits. The assembly may further include suspension means for suspending the conduits. In use, the training cover assembly may form at least one internal pressurized chamber.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1A:
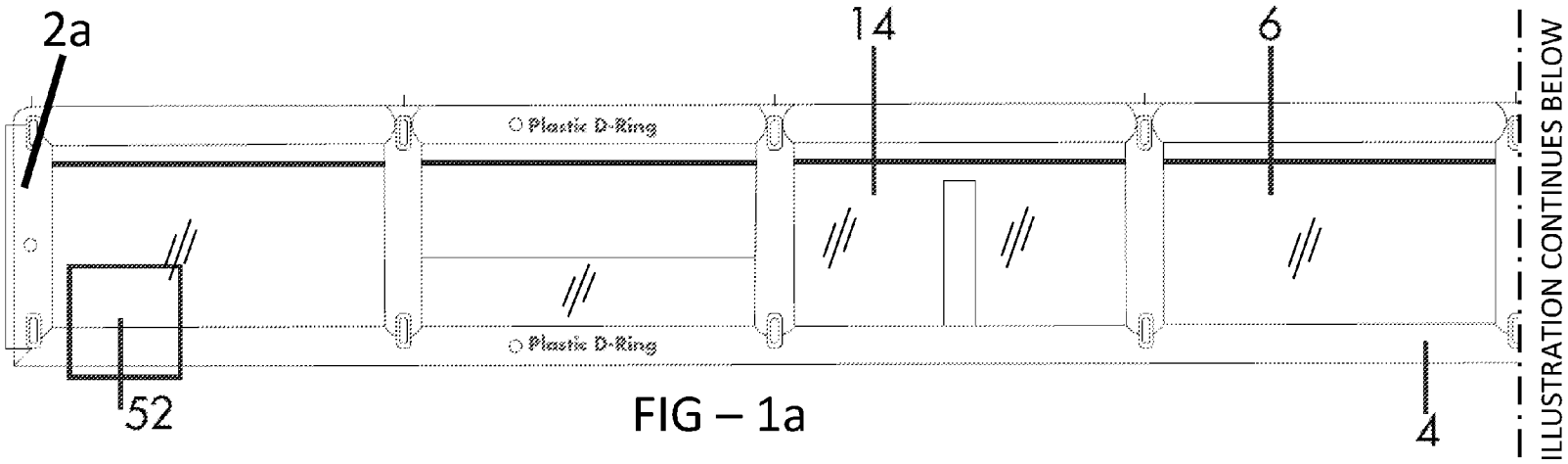
FIG. 1*a* is a side view of a swimming pool cover assembly in accordance with an embodiment of the present invention.
Figure 1A:
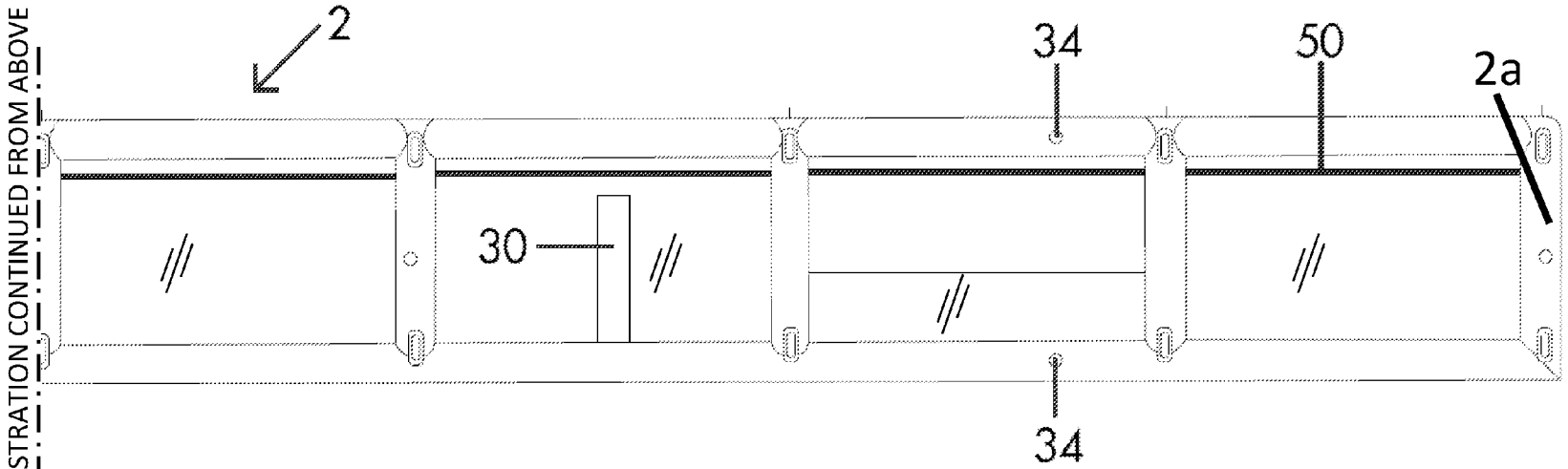
Figure 1B:
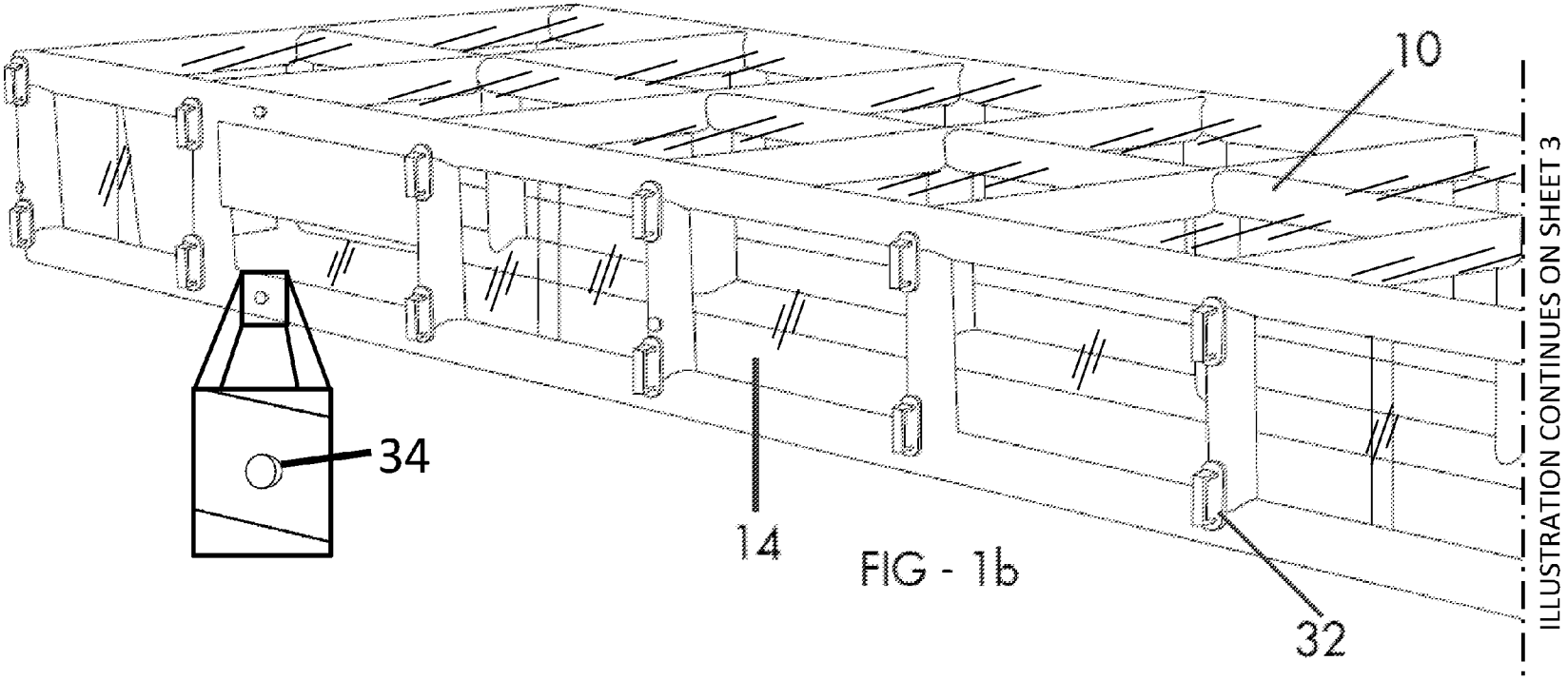
FIG. 1*b* is a upper perspective view of the swimming pool cover assembly of FIG. 1*a;*
Figure 1B:
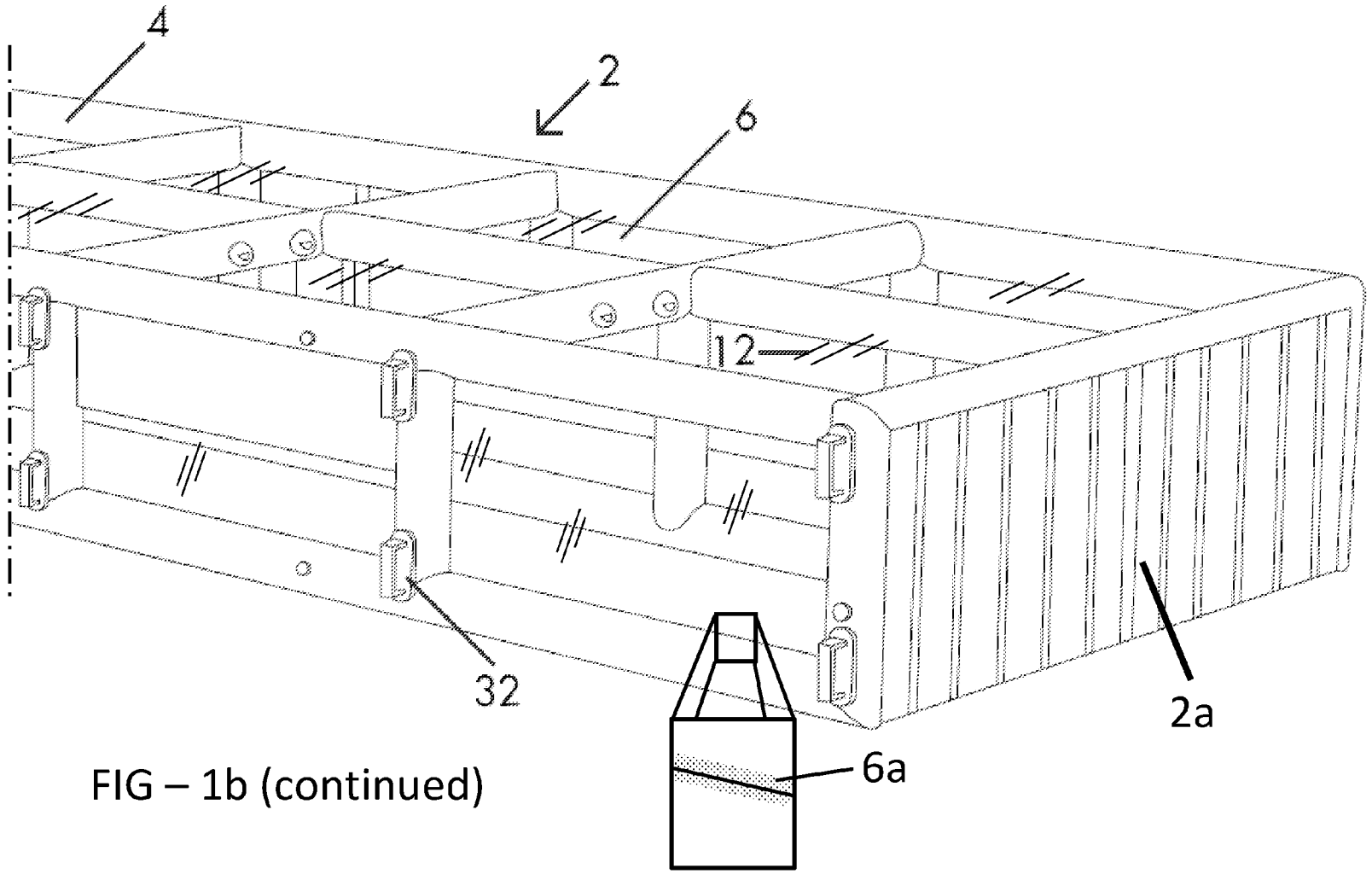
Figure 1C:
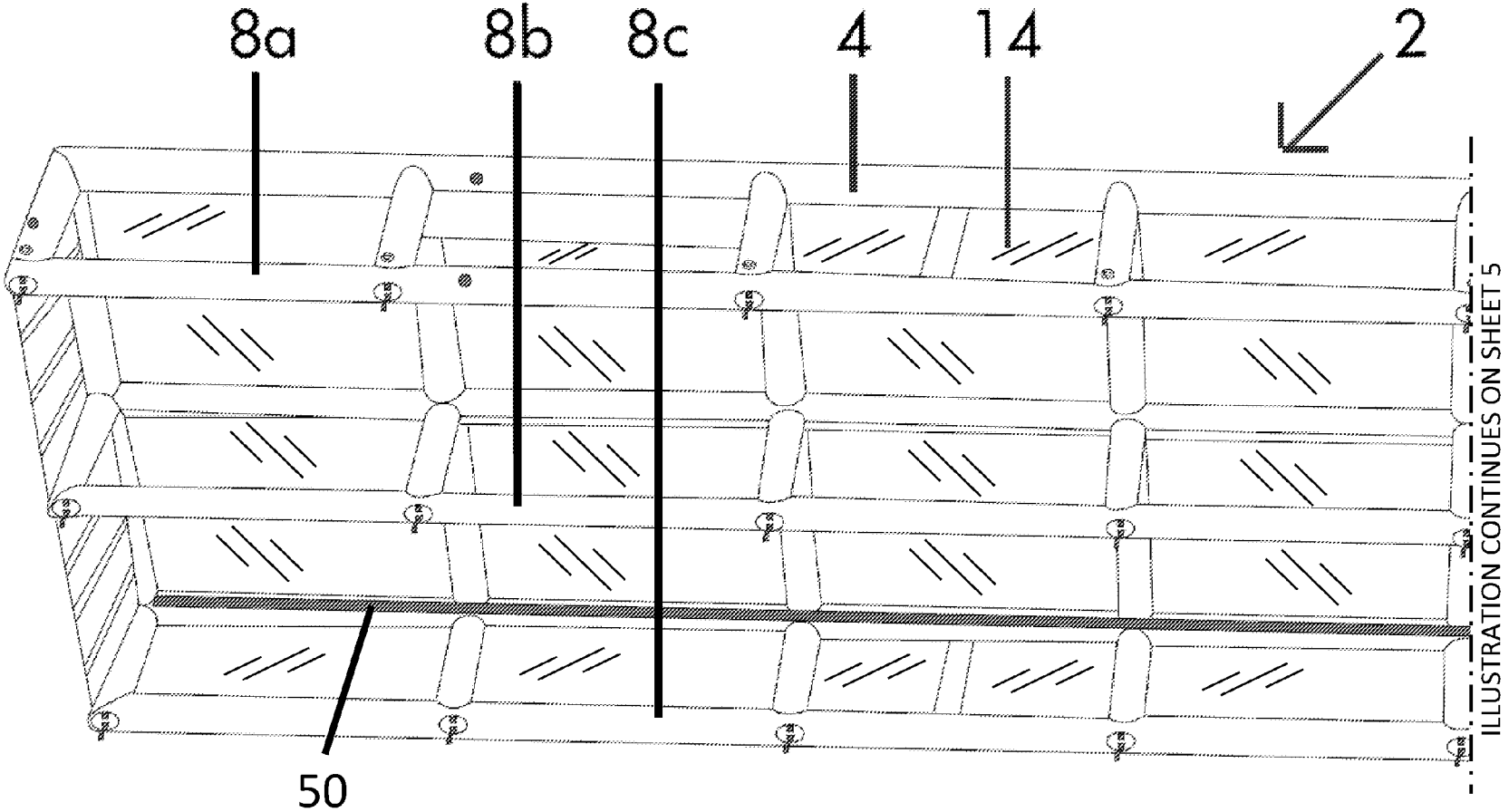
FIG. 1*c* is a lower perspective view of the swimming pool cover assembly of FIG. 1*a;*
Figure 1C:
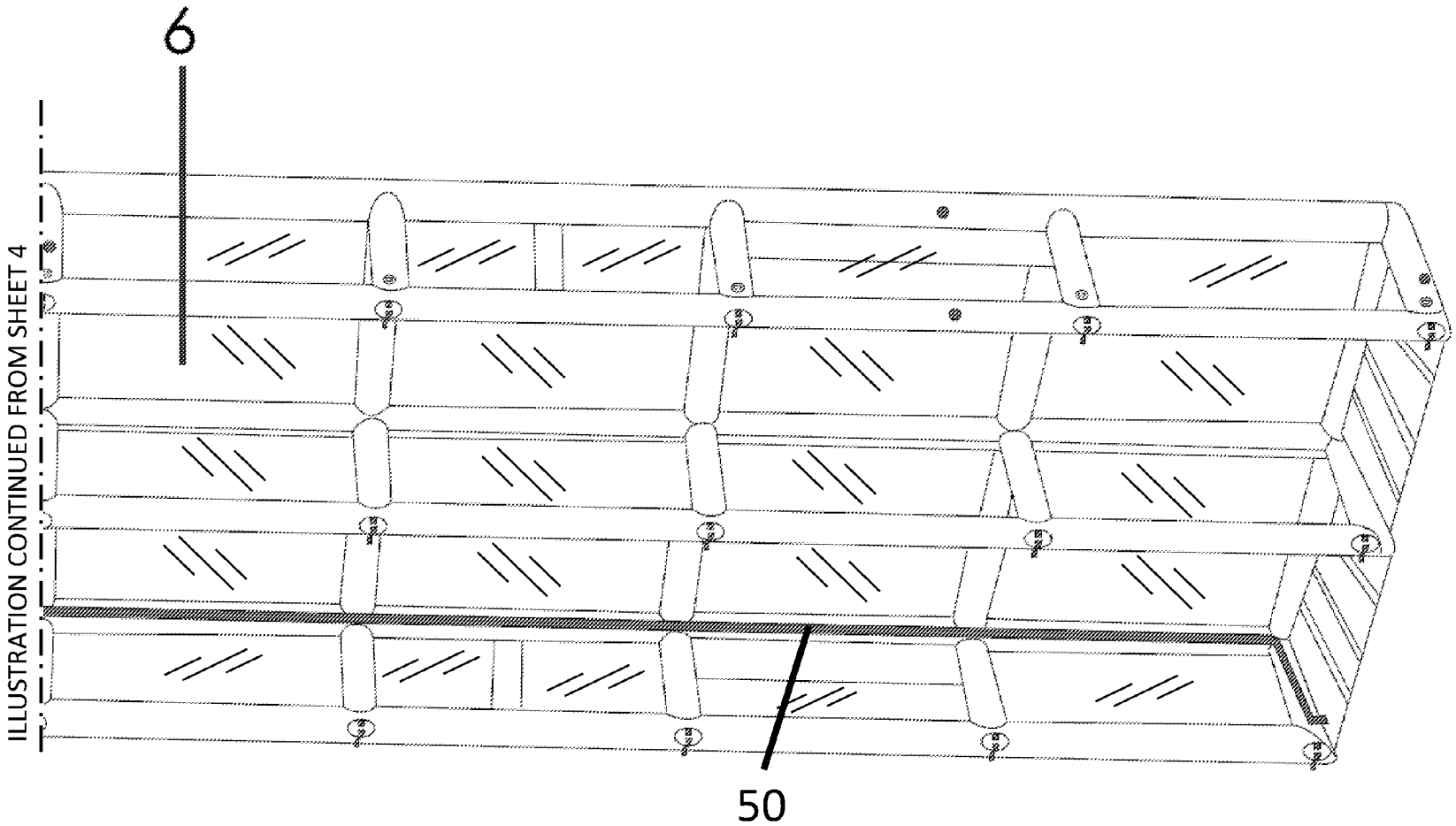
Figure 1D:
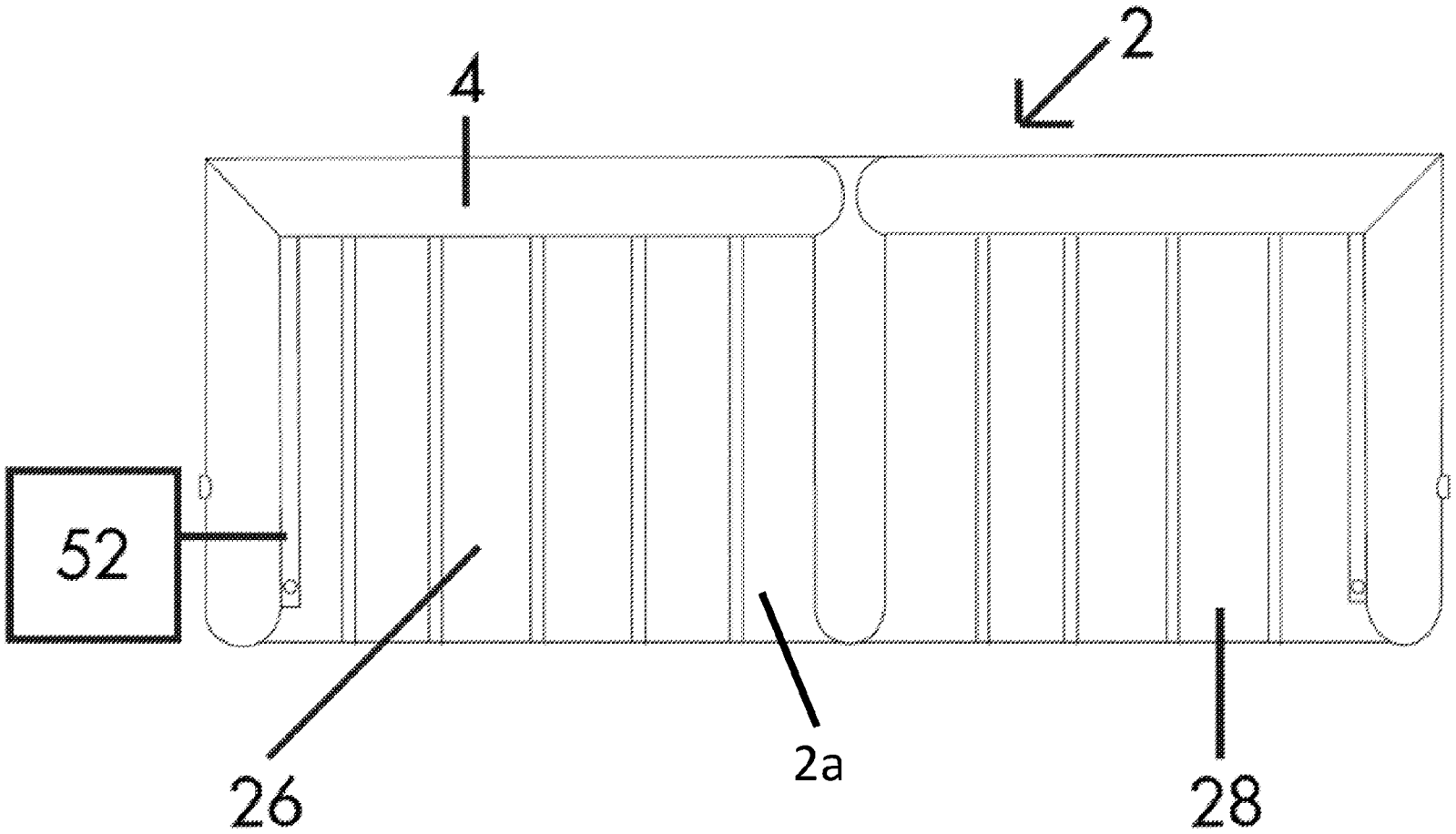
FIG. 1*d* is an end view of the swimming pool cover assembly of FIG. 1*a;*

According to an embodiment of the present invention, there is provided a cover assembly 2 which forms a pressurized chamber for swimming training as shown in FIG. 1. The swimming pool cover assembly 2 includes an inflatable frame 4 formed from an interconnected three-dimensional (3D) lattice of inflatable tubes. The cover assembly 2 further includes a cover 6 supported by the frame 4 to cover a swimming pool (not shown). The cover 6 partitions off the pool from its surrounds so that the chamber can be pressurized to simulate altitude training. Advantageously, the cover assembly 2 can be conveniently set up at a local pool to enable athletes to altitude train without needing to go to the trouble and expense of traveling to the mountains.

The entire frame 4 can be inflated at a single inflation point as the inflatable tubes are in fluid communication with each other. As can best be seen in FIG. 1*c*, the frame 4 includes three wall frame portions 8*a*, 8*b*, 8*c*. Each adjacent pair of wall frame portions 8 are aligned along the sides of a respective swimming lane. As can best be seen in FIG. 1*b*, the frame 2 also includes an inflatable roof portion 10 forming a rectangular multi-dimensional array.

The cover 6 includes multiple panels of sheet material for releasably affixing with a hook-and-loop (e.g. Velcro™) fastening arrangement 6*a* to the top and sides of the frame 4. In particular, the cover 6 includes a roof sheet 12 for covering the roof portion 10 and removable side panels 14 for affixing within endless rectangular portions of the external and internal (i.e. partitioning) wall frame portions 8. The sheet material is air impervious and formed from transparent polymeric or plastic material.

The cover assembly 2 further includes four strip doors 26 at its ends 2*a* and in register with the swimming lanes. Each strip door 26 includes a number of hanging PVC strips 28. In addition, some of the side panels 14 can have entry/exit slits 30 which can be releasably closed with a hook-and-loop (e.g. Velcro™) fastening arrangement.

The frame 4 includes handles 32 to facilitate handling when the fame 4 is deflated. The handles are located at the corners of each endless rectangular portion of the wall frame portions 8*a*, 8*c* that are external. The frame 4 includes fastening rings 34 through which backstroke flags can be transversely fed and fastened across the inside of the cover assembly 2. The inflatable frame 4 is formed by stitching, gluing or thermal welding polyvinyl chloride polyvinyl chloride (PVC) material together. In practice, a blower can be continually required to inflate the inflatable frame 4 as air leaks from the frame 4.

The cover assembly 2 further includes conduits 50 suspended in the pressure chamber from the top of respective wall frame portions 8. The conduits convey air into and out of the chamber of the cover assembly 2 to adjust the air conditions within the internal chamber as required to simulate altitude (e.g. up to 3.5 km above sea level). The cover assembly 2 further includes a pump 52 for pumping air in or out of the internal chamber via the conduits 50. Typically, the pump 52 is a blower and blows air of reduced oxygen content (compared with the surrounding atmosphere) into the chamber. However, the internal air pressure of the chamber is only slightly greater than the external atmospheric pressure. In this manner, the blower takes in air from the surrounding atmosphere, and adjusts the oxygen content in the air, before providing the air into the chamber.

The cover assembly 2 as long enough to completely cover a 25 meter or 50 meter swimming pool. The separation between each adjacent pair of wall frame portions 8 accommodates a swimming lane.

Figure 2:
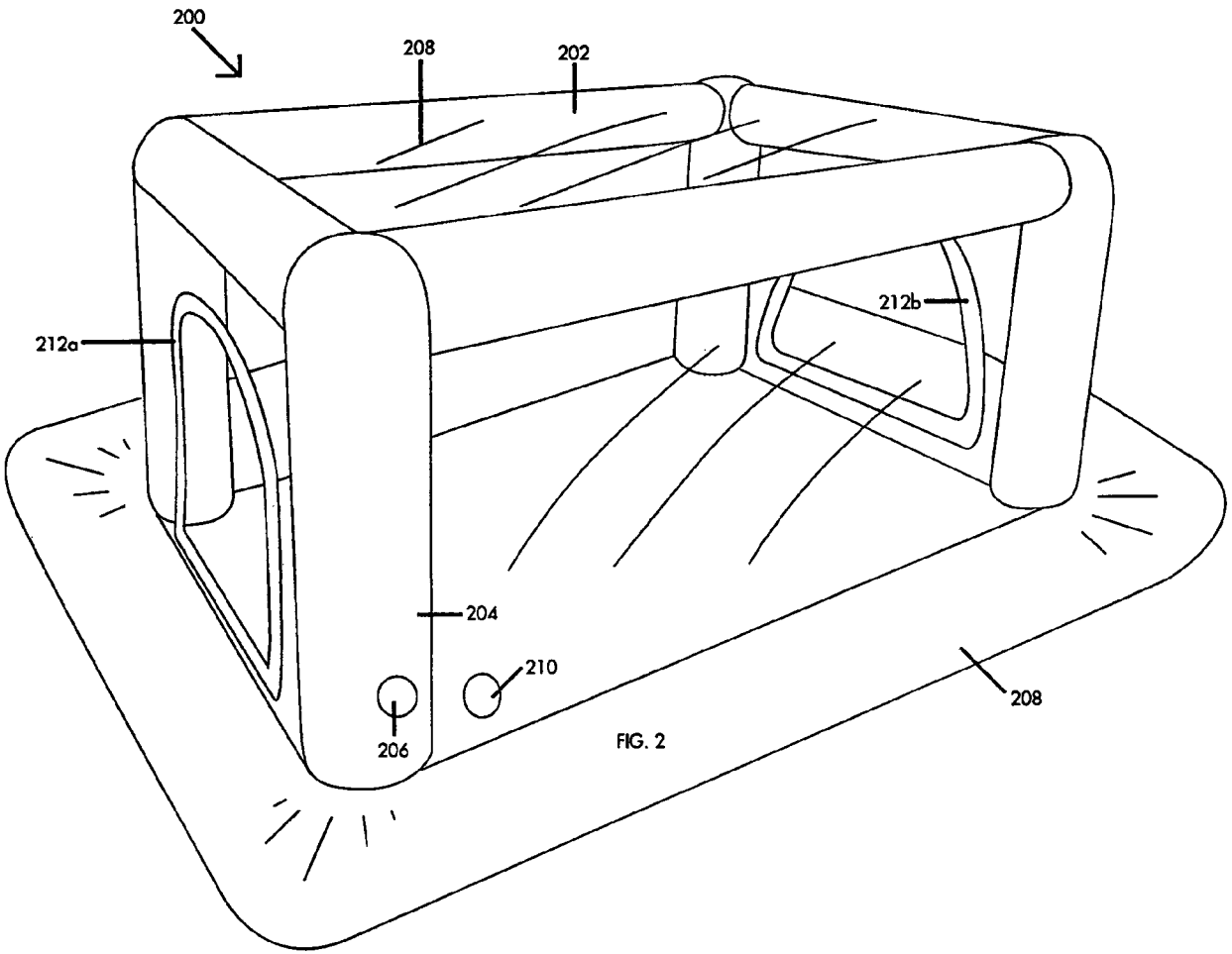
FIG. 2 is a perspective view of a bed cover assembly in accordance with another embodiment of the present invention.

FIG. 2 shows a bed cover assembly 200 in which a king sized bed or exercise bike can be located. The bed cover assembly 200 includes an inflatable frame 202. The frame 202 is rectangular and a leg portion 204 of the frame includes a valve 206 through which air can be pumped during inflation. An oversized sheet cover 208 is sealingly fastened along each inflatable straight portion of the frame 202, and rests on the ground adjacent the frame 202 to facilitate sealing of the internal pressure chamber. Advantageously, the pressure chamber does not have an internal floor which could otherwise be breached by a leg of the bed.

The cover 208 is fitted with a one-way valve 210 (i.e. pressure adjustment means) for facilitating adjustment of the pressure in the pressure chamber with a connected pump. The cover 208 also includes a pair of re-sealable zip or loop-and-hook entrances 212*a*, 212*b* to gain access to the chamber.

Figure 3:
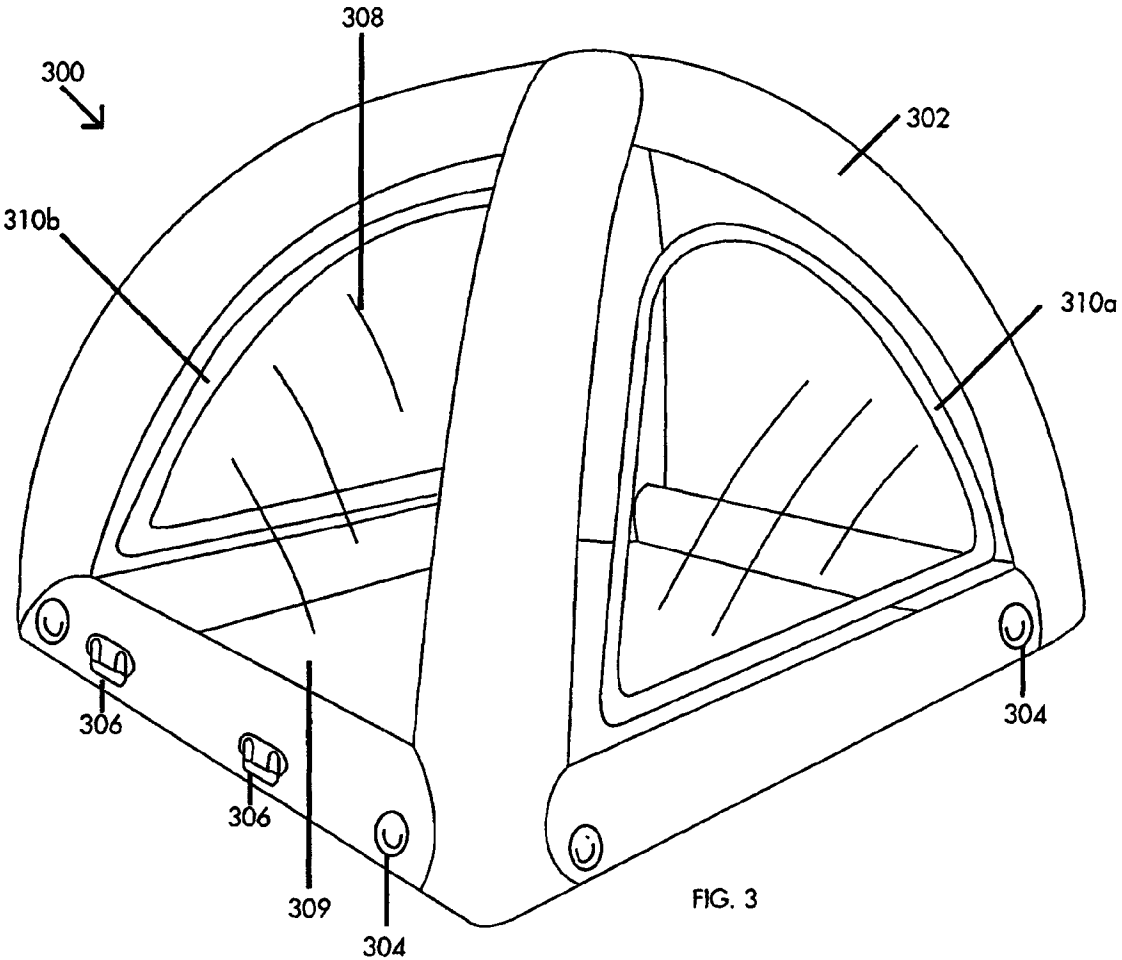
FIG. 3 is a perspective view of a seat cover assembly in accordance with another embodiment of the present invention.

FIG. 3 shows a seat (e.g. lounge chair or couch) cover assembly 300. The assembly includes an inflatable frame 302 having a square base portion and two crisscrossed arch portions. Anchor lugs 304 are located at each corner of the base portion, and handles 306 extend from the frame 302 to facilitate handling.

The cover assembly 300 includes a transparent sheet cover 308 sealingly fastened along each inflatable portion of the frame 202. In addition, a transparent sheet floor 309 is sealingly fastened along each straight inflatable portion of the base of the frame 202. The cover 308 also includes a pair of re-sealable zip or loop-and-hook entrances 310*a*, 310*b* to gain access to the sealed internal chamber. A valve is provided in the cover 308 to facilitate pressurizing the chamber with an external vacuum pump.

Advantageously, the embodiments of FIGS. 2 and 3 enable athletes to undergo altitude conditioning when relaxing at home in bed or on a seat, or using an exercise bike.

Figure 4:
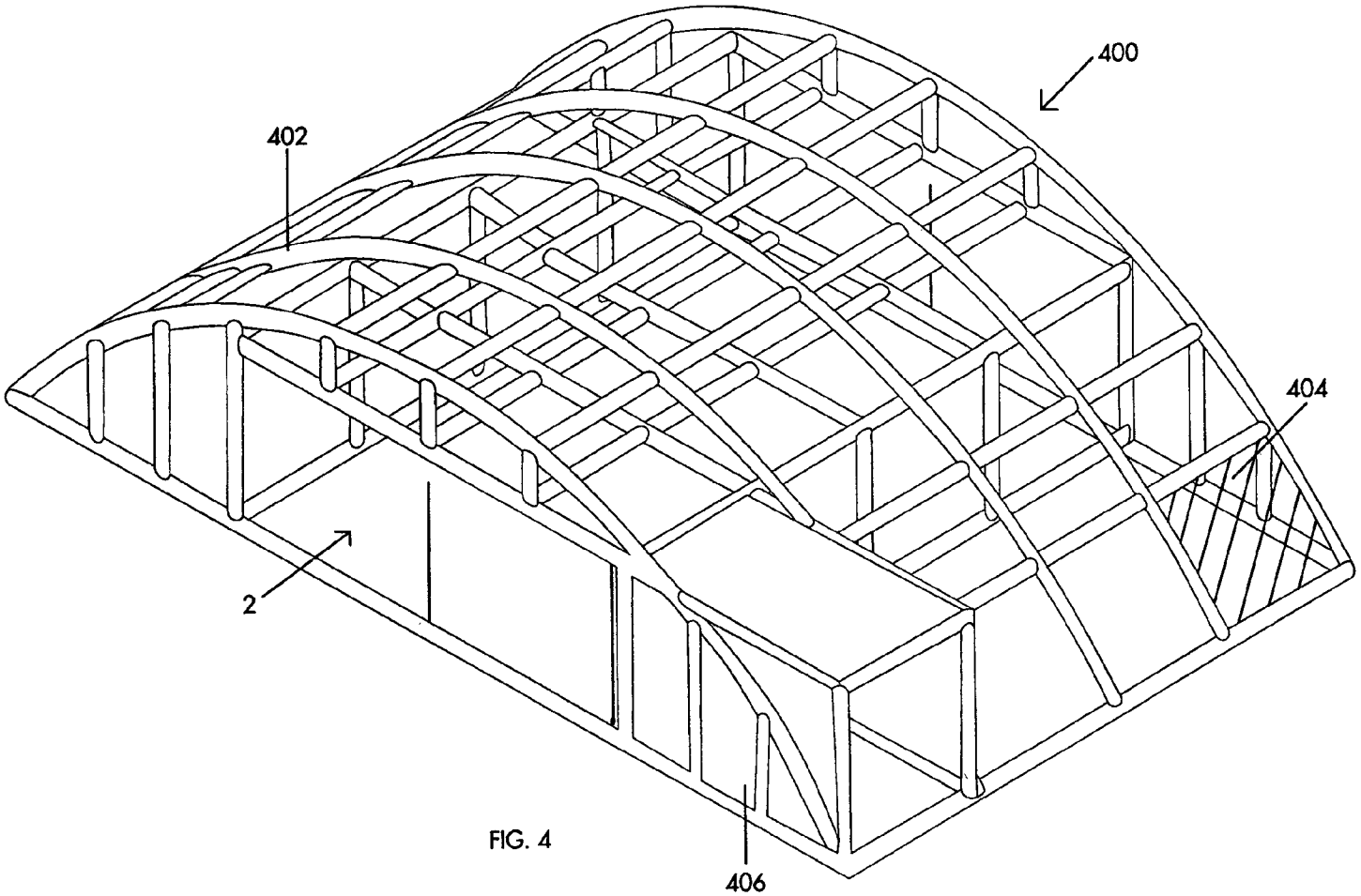
FIG. 4 is a perspective view of inflatable dome cover assembly including the swimming pool cover assembly of FIG. 1.

FIG. 4 shows an inflatable dome cover assembly 400 including dome lattice framework 402 which can be provided over the swimming pool cover assembly 2. The framework 402 includes a number of arched and straight inflatable portions which are in fluid communication with each other. Individual roof panels 404 can be fitted within each cell of the lattice framework 402. Alternatively, a flaccid sheet cover can cover the framework 402. The dome cover assembly 400 further includes a built-in pump storage container 406 for containing the pump 52. In turn, the pump fills the inflatable portions of the framework 402 and swimming pool cover assembly 2, and adjusts the oxygen content and pressure inside the chambers within the swimming pool cover assembly 2.

A person skilled in the art will appreciate that many embodiments and variations can be made without departing from the ambit of the present invention.

In the preferred embodiment, the pump adjusted the pressure and oxygen content of the air in the chamber. In a further embodiment, the pump may also adjust the humidity, temperature or other like air conditions.

In one embodiment, the inflatable tubes (i.e. portions) of the frame 4 may be partitioned into isolated sections which are separately inflatable so that a puncture or leak in one section will not result in deflation of the other sections.

In one embodiment, the cover 6 can consist of a single sheet of material.

In one embodiment, the cover assembly 2 can be located over a running track to cover running lanes. The cover assembly 2 may be a 45 m×1.6 m×2.2 m long unit designed for hypoxic sprint training. In one embodiment, the present invention can be utilised in an animal exercise training area for training animals such as horses.

In one embodiment, the cover assembly 2 includes at least one internal partition to form more than one internal pressure chamber in register with respective lanes, with each chamber able to be kept at a different pressure.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

What is claimed is:

1. A swimming pool cover assembly including:

a frame including at least one inflatable portion, the frame comprising interconnected three-dimensional (3D) lattice of inflatable straight tubes;

at least one cover for being supported by the frame to define an exercise chamber including at least part of a swimming pool; and adjustment means for reducing an oxygen content of air in the exercise chamber compared with air external the exercise chamber, wherein the exercise chamber has elongate sidewalls.

2. The swimming pool cover assembly of claim 1, wherein the frame includes wall frame portions with each wall frame portion forming a two-dimensional array of inflatable tubes.

3. The swimming pool cover assembly of claim 1, wherein the frame includes a roof portion forming a rectangular multi-dimensional array.

4. The swimming pool cover assembly of claim 3, wherein each wall frame portion, including a roof wall frame portion, is disposed at a right angle relative to each adjacent wall frame portion.

5. The swimming pool cover assembly of claim 1, wherein the cover includes a single sheet or multiple sheets of material for affixing to the frame and the cover assembly forms an open bottom.

6. The swimming pool cover assembly of claim 5, wherein the material is formed from polymeric material and is affixed to the frame using a hook-and-loop fastening arrangement.

7. The swimming pool cover assembly of claim 1, including a partition for partitioning the inside of the assembly into respective chambers.

8. The swimming pool cover assembly of claim 1, wherein the cover is dimensioned to cover an exercise training area including one or more training lanes.

9. The swimming pool cover assembly of claim 8, wherein the swimming pool cover assembly is dimensioned to completely cover at least one swimming lane of a 25 meter or 50 meter pool.

10. The swimming pool cover assembly of claim 8, wherein adjacent pairs of wall frame portions of the frame can be aligned along the sides of a respective training lane.

11. The swimming pool cover assembly of claim 1, wherein the frame includes fastening means to which backstroke flags can be transversely fastened across the assembly.

12. The swimming pool cover assembly of claim 1, wherein the adjustment means includes a pump or blower for pumping low oxygen air into the exercise chamber for reducing the oxygen content of the air in the exercise chamber.

13. The swimming pool cover assembly of claim 1, wherein the adjustment means includes a valve in fluid communication with the exercise chamber.

14. The swimming pool cover assembly of claim 1, wherein said cover is oversized to facilitate sealing of the exercise chamber adjacent the frame.

15. The swimming pool cover assembly of claim 1, wherein the cover includes at least one re-sealable entrance to gain access to the exercise chamber.

16. The swimming pool cover assembly of claim 1, further including an inflatable dome lattice framework for covering the frame.

17. The swimming pool cover assembly of claim 1, wherein the adjustment means for adjusting oxygen content in the exercise chamber reduces oxygen in the exercise chamber to simulate athletic training at high altitude for a user in the exercise chamber.

18. The swimming pool cover assembly of claim 17, wherein the assembly simulates athletic training at up to 3.5 kilometers above sea level.

19. The swimming pool cover assembly of claim 1, wherein each inflatable tube, including tubes to support a roof portion of the cover, connects with each adjacent tube at a right angle.

20. The swimming pool cover assembly of claim 1, wherein:

the frame includes a plurality of openings located between the 3D lattice of inflatable straight tubes;

when supported by the frame, the cover:

covers the plurality of openings; and maintains the reduced oxygen content of air in the exercise chamber compared with air external the exercise chamber.

* * * * *